United States Patent [19]

Osmera et al.

[11] Patent Number: 4,648,591

[45] Date of Patent: Mar. 10, 1987

[54] APPARATUS FOR POCKETING DOCUMENTS IN VERTICALLY ALIGNED POCKETS

[75] Inventors: Miroslav S. Osmera, Waterloo; Anton Bella; Fredrik L. N. Kallin, both of Kitchener, all of Canada; Edward R. Evans, Annapolis, Md.

[73] Assignee: NCR Corporation, Dayton, Ohio

[21] Appl. No.: 745,544

[22] Filed: Jun. 17, 1985

[30] Foreign Application Priority Data

Sep. 13, 1984 [GB] United Kingdom ..... 8423151

[51] Int. Cl.[4] ..... B65H 5/02

[52] U.S. Cl. ..... 271/305; 271/273; 271/188; 271/209

[58] Field of Search ..... 271/184, 185, 272–274, 271/287–298, 303, 305, 306, 188, 209

[56] References Cited

U.S. PATENT DOCUMENTS

| | | | |
|---|---|---|---|
| 3,467,371 | 9/1969 | Britt et al. | 271/290 |
| 3,913,905 | 10/1975 | Schulze | 271/292 |
| 3,973,769 | 8/1976 | Cross et al. | 271/296 |
| 4,111,410 | 9/1978 | Tates et al. | 271/288 |
| 4,124,204 | 11/1978 | Van Buskirk | 271/273 |
| 4,318,542 | 3/1982 | Altman et al. | 271/305 |

FOREIGN PATENT DOCUMENTS

| | | | |
|---|---|---|---|
| 0093766 | 7/1980 | Japan | 271/296 |
| 2059397 | 4/1981 | United Kingdom | 271/297 |
| 2065612 | 7/1981 | United Kingdom | 271/297 |

*Primary Examiner*—Richard A. Schacher

*Attorney, Agent, or Firm*—Wilbert Hawk, Jr.; Albert L. Sessler, Jr.; Elmer Wargo

[57] ABSTRACT

An apparatus for pocketing documents in vertically-aligned pockets. The apparatus includes a frame and slides for mounting the frame for reciprocal movement between a home position and an extended position relative to the apparatus. A plurality of vertically-aligned, pocket members is mounted on the frame for selectively receiving documents to be pocketed. A transfer station, having first and second track members, receives a document therebetween, with the first track member being mounted on the frame for movement therewith. A first transport apparatus is used to move a document in a first direction to said transfer station, and a second transport apparatus is used to move a document in a second direction from the transfer station to the plurality of pocket members. A transfer apparatus is used to transfer a document at the transfer station from the first transport apparatus to said second transport apparatus. The first track member is moveable in the first direction when the frame is moved from said home position to the extended position to enable a document which may jam at the transfer station to be removed therefrom.

17 Claims, 17 Drawing Figures

APPARATUS FOR POCKETING DOCUMENTS IN VERTICALLY ALIGNED POCKETS

BACKGROUND OF THE INVENTION

This invention relates to an apparatus which is used for pocketing documents in vertically aligned pockets.

In a typical data processing application such as the sorting of documents like checks or punched cards, for example, the series of pockets into which the documents are sorted are generally aligned in a horizontal direction. For some applications, the series of pockets is aligned in a vertical direction; this is true when space considerations are very important.

One of the situations which is encountered with a pocketing apparatus having vertically-aligned pockets is that there generally is a change of direction required in transporting the documents. In this regard, the documents are moved in one direction (generally horizontally) to a transfer station, and thereafter, they are moved in a second direction (generally downwardly) to a plurality of vertically-aligned pocket members where they are selectively sorted into individual pockets.

One of the problems encountered with a pocketing apparatus of the type described in the previous paragraph is that documents tend to jam at the transfer station where the change of direction is effected, making extraction of the jammed document difficult. Another problem with the prior-art pocketing apparatuses of the type described is that the transfer mechanisms at the transfer station are complex and expensive to produce and maintain.

SUMMARY OF THE INVENTION

The apparatus for pocketing documents in vertically-aligned pockets of this invention obviates the problems mentioned above.

In a preferred embodiment of the invention, the apparatus comprises: a plurality of pocket members for selectively receiving documents to be pocketed; a transfer station to receive said documents to be pocketed; a first means and a second means positioned at said transfer station to receive said documents therebetween; first moving means for moving a said document to be pocketed in a first direction to said transfer station; second moving means for moving said document in a second direction from said transfer station to said plurality of pocket members; and means for mounting one of said first and second means for movement along said first direction to facilitate removing a said document which may become jammed at said transfer station.

BRIEF DESCRIPTION OF THE DRAWING

FIGS. 5A and 5B are to be positioned for combined viewing;

DETAILED DESCRIPTION OF THE INVENTION

Figure 1:
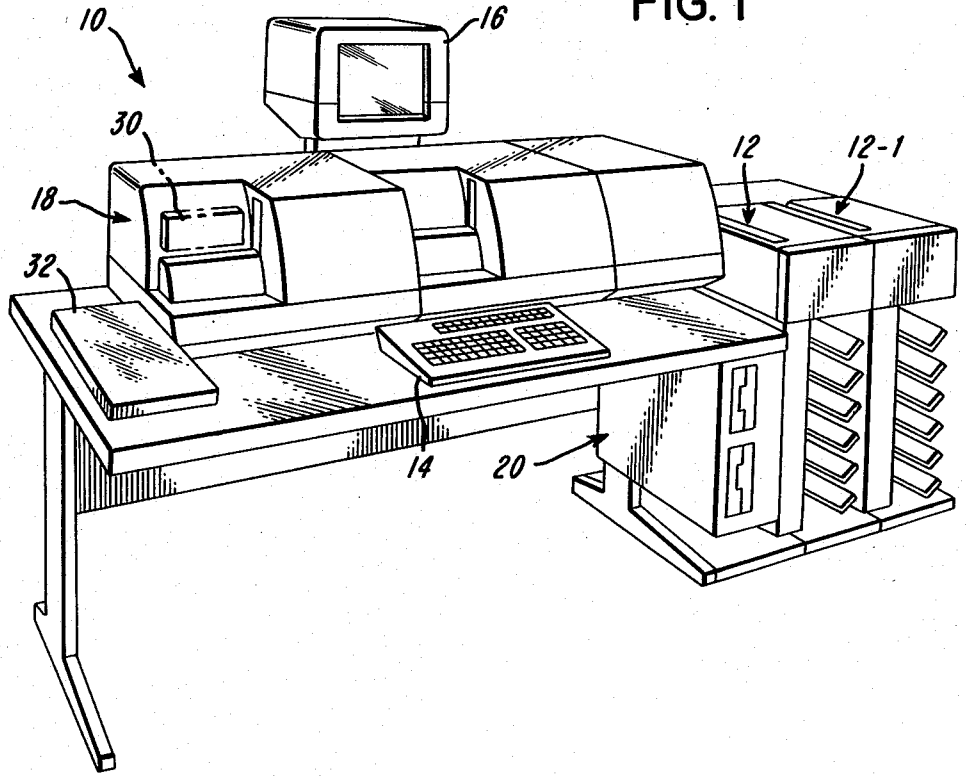
FIG. 1 is a general view, in perspective, showing a preferred embodiment of the pocketing apparatus of this invention as it is used in a typical data processing environment.

FIG. 1 is a general, perspective view of a data processing system 10 in which a preferred embodiment of the apparatus 12 for pocketing documents, made according to this invention, may be used.

The system 10 (FIG. 1) portrayed includes an encoder, although, naturally, the apparatus 12 may be used with other data processing equipment in which pocketing or sorting of documents is required. Basically, an encoder is an apparatus which prints or encodes the courtesy amount (monetary amount) of documents like checks in MICR ink on the front of the associated documents. Additionally, the system 10 performs certain bank-stamping functions on the backs of the documents. The system 10 includes a keyboard (KB) 14, a display 16 and the various, known, encoder components such as a MICR printer, etc., 18 for performing the various functions described.

Figure 2:
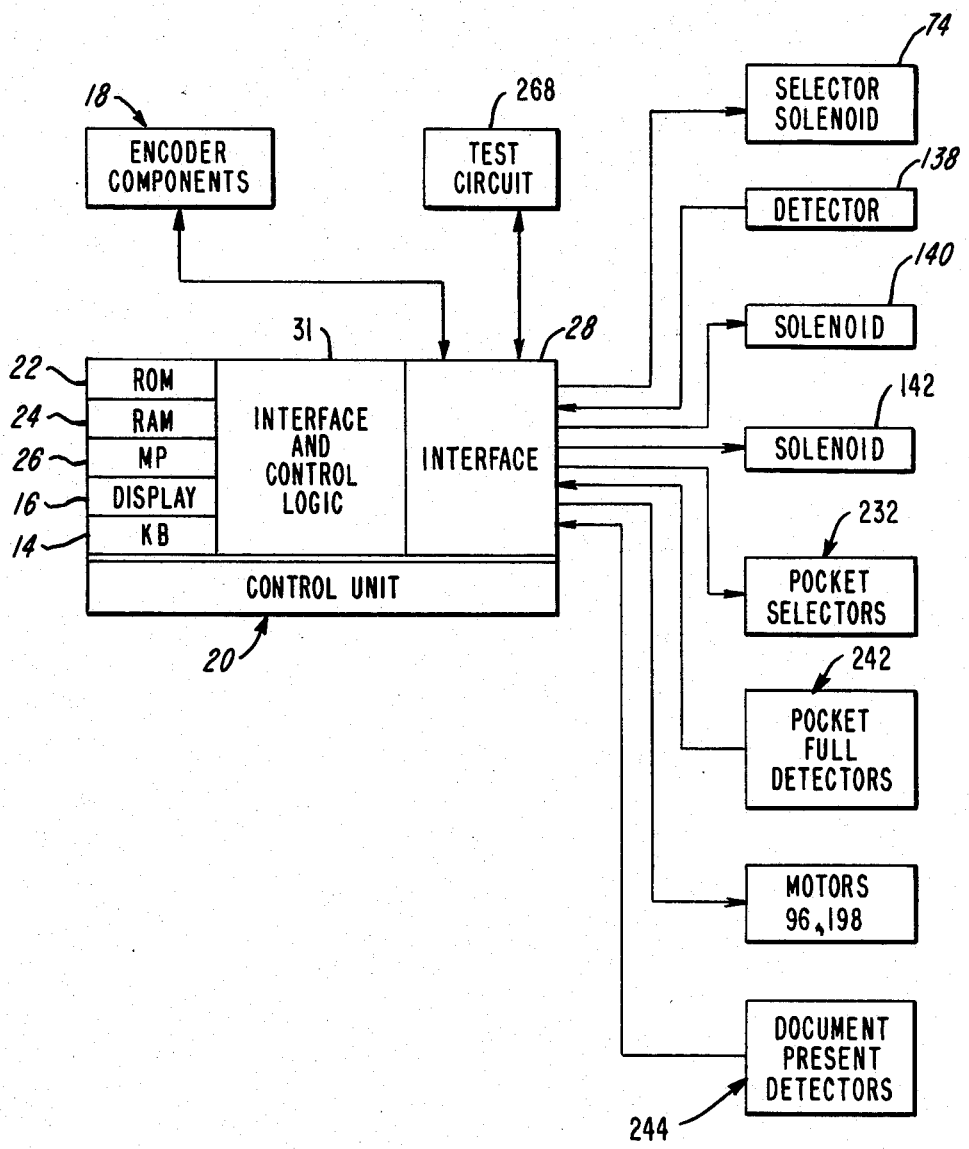
FIG. 2 is a schematic diagram of a control unit which is used in the data processing environment shown in FIG. 1.

The system 10 also includes a control unit 20 which is shown schematically in FIG. 2. The relationship of the control unit 20 to the apparatus 10 will be described hereinafter. At this time, it is sufficient to state that the control unit 20 is conventional and that it has: a read only memory (ROM) 22; random access memory (RAM) 24; a processor (MP) 26; the keyboard (KB) 14 for entering data; a display 16 for communicating with an operator; an interface 28 for coupling the control unit 20 to other components to be described; and interface and control logic 31 to connect the various elements of the control unit 20. The various programs or routines for controlling the operation of the control unit 20 and the system 10 may be stored in the ROM 22 or loaded daily into the RAM 24 to enable the control unit 20 to function as what is generally referred to as an "intelligent" processor or terminal.

Figure 3:
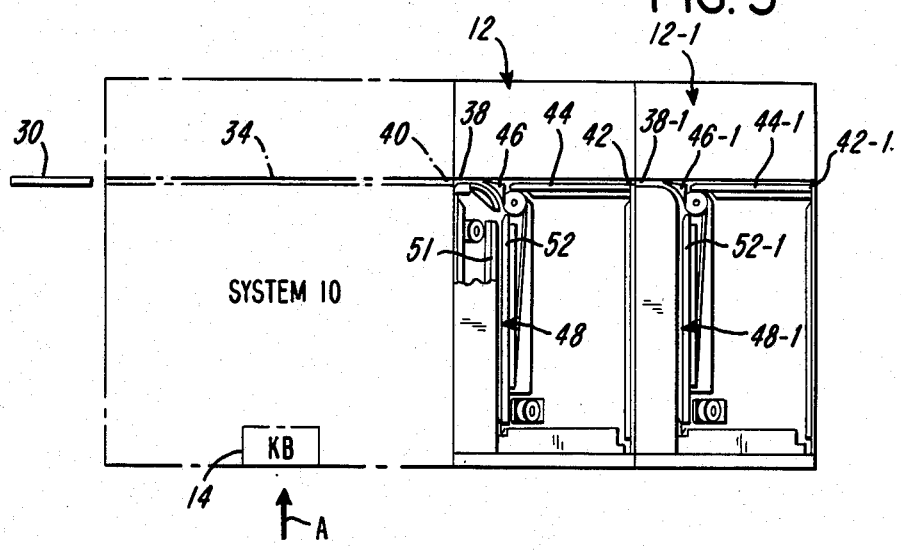
FIG. 3 is a schematic diagram of a plan view of the apparatus shown in FIG. 1 and is used to show the flow of documents in the apparatus.
Figure 4:
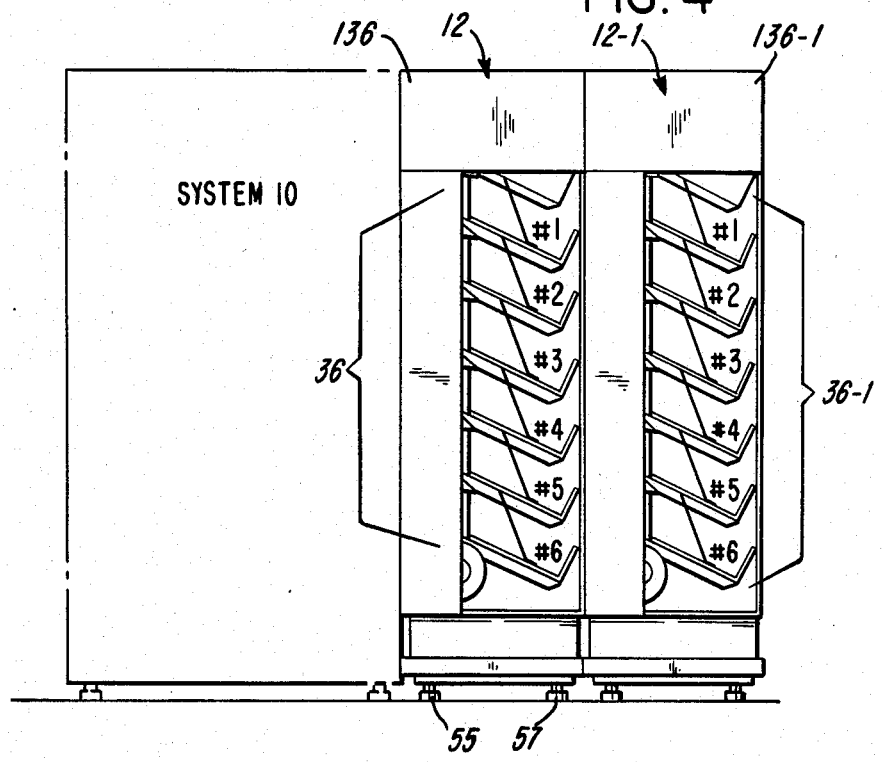
FIG. 4 is a schematic diagram, in elevation, and is taken from the direction A of FIG. 3 to show additional details of the pocket members for each of the pocketing apparatuses shown.

In using the system 10 shown in FIG. 1, an operator, for example, picks a document 30 from the stack 32, reads the courtesy amount from the document, enters the amount and other conventional control data on the keyboard 14, and thereafter, hand drops the document 30 into the document track 34, shown schematically in FIG. 3. The document 30 is moved in the track 34 where the encoder components 18 perform the encoding of the courtesy or monetary amount on the document mentioned and also perform the bank stamping functions mentioned. After encoding and stamping, the document 30 is transferred to the apparatus 12 where the document may be pocketed in one of the pocket members (#1 through #6) of the group 36 (FIG. 4).

One of the features of the present invention is that the free-standing apparatus 12 is modular in construction, and multiple units of the apparatus 12 can be assembled in side-by-side relationship to increase the associated, pocketing capacity of the system 10. For example, the apparatus 12 has an entry port 38 (FIG. 3) which is aligned with the exit port 40 of the document track 34 to receive the documents 30 from the system 10. The apparatus 12 also has an exit port 42 and a document transporting track 44 which connects the input and output ports 38 and 42. A conventional selector 46 is positioned relative to the track 44 to assume two different positions with regard to the track 44. In a first or actuated position, for example, the selector 46 deflects a document 30 out of the track 44 and directs it to a transfer station designated generally as 48. In the second position, the selector is spring biased to an inoperative position so that documents 30 will not be pocketed but will pass to the exit port 42 of apparatus 12.

The transfer station 48 (FIG. 3) includes first and second means for receiving a document 30 therebetween; these first and second means will be referred to conveniently as first and second track members 51 and 52, respectively, and they are shown only schematically in FIG. 3. In the embodiment described, the documents, like 30, are moved on their long, lower edges, and they are moved in a generally-horizontal direction when they are moved from the track 34, to the track 44 (FIG. 3), and to the transfer station 48. At the transfer station 48, means (to be later described) are provided to move the documents in a downwardly, vertical direction to the various pocket members 36 (shown within a bracket) which pocket members are individually numbered from #1 to #6 in FIG. 4. The selection of the individual pockets #1 to #6 in which the documents, like 30, are to be pocketed is controller by the control unit 20 shown in FIG. 2. Certain control data on the documents themselves or the control data entered at the keyboard 14 may be used to provide the pocket destinations for the documents.

As previously stated, the construction of the apparatus 12 is modular, so that if more than six pockets are required in the system 10, an identical apparatus 12-1 is provided as shown in FIG. 3. The same basic number in apparatus 12-1 is used to describe a corresponding part already described in relation to apparatus 12; however, a "dash one" (-1) designation is given to the part in apparatus 12-1. For example, the transfer station 48-1 in apparatus 12-1 is identical to transfer station 48 in apparatus 12.

With this modular construction, if an encoded document 30 is to be routed to pocket #4 of pockets 36-1 (FIG. 4) of the apparatus 12-1, for example, the control unit 20 (FIG. 2) will issue the appropriate control (if necessary) to position the selector 46 (FIG. 3) in the second position, permitting the document to move in track 44, out the exit port 42 of apparatus 12, and into the track 44-1 of apparatus 12-1. The control unit 20 will also issue the appropriate control to position the selector 46-1 of the apparatus 12-1 in the first position to deflect the document to the transfer station 48-1. From there, the document 30 will be moved downwardly and directed into pocket member #4 of the group 36-1 as previously described.

In the example described, it is the control unit 20 of the system 10 which controls the operation of the apparatuses 12 and 12-1; however, other control arrangements could be utilized. If more than the two apparatuses 12 and 12-1 are required for pocketing capacity, additional such apparatuses may be added to the system 10.

Having described, generally, the functioning of the system 10 and the apparatus 12, it appears appropriate to discuss the details of the apparatus 12. In this regard, FIGS. 5A and 5B, taken together, depict a plan view of the portions of the apparatus 12 already described in relation to FIG. 3. Certain panels and covers, not shown and not important to this invention, are removed to facilitate a showing of the apparatus 12. Also, certain of the elements included in FIGS. 5A and 5B are shown schematically to simplify these figures.

Figure 5C:
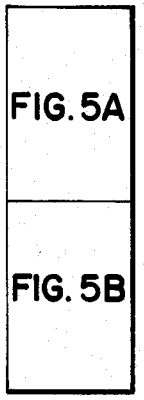
FIG. 5C is a schematic diagram showing how
Figure 5A:
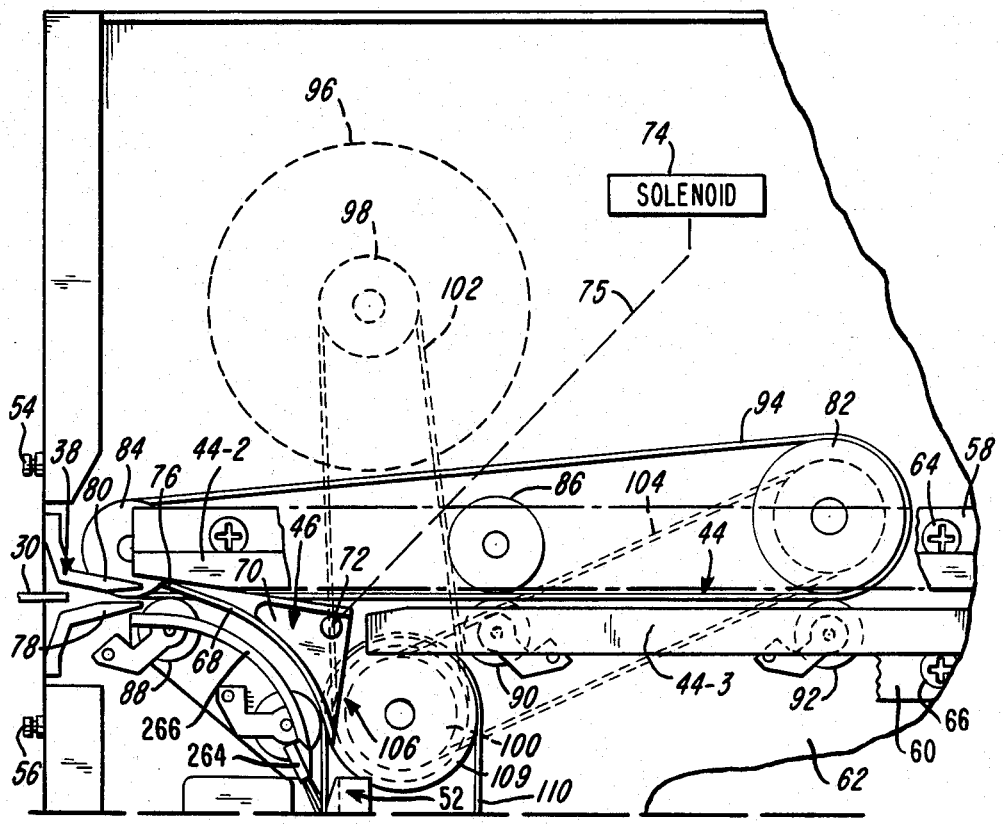
FIGS. 5A and 5B, taken together, show a plan view of the pocketing apparatus, with the view being similar to FIG. 3; the various covers are removed to show the inside of the apparatus, and several components are shown schematically to simplify the drawing.
Figure 5B:
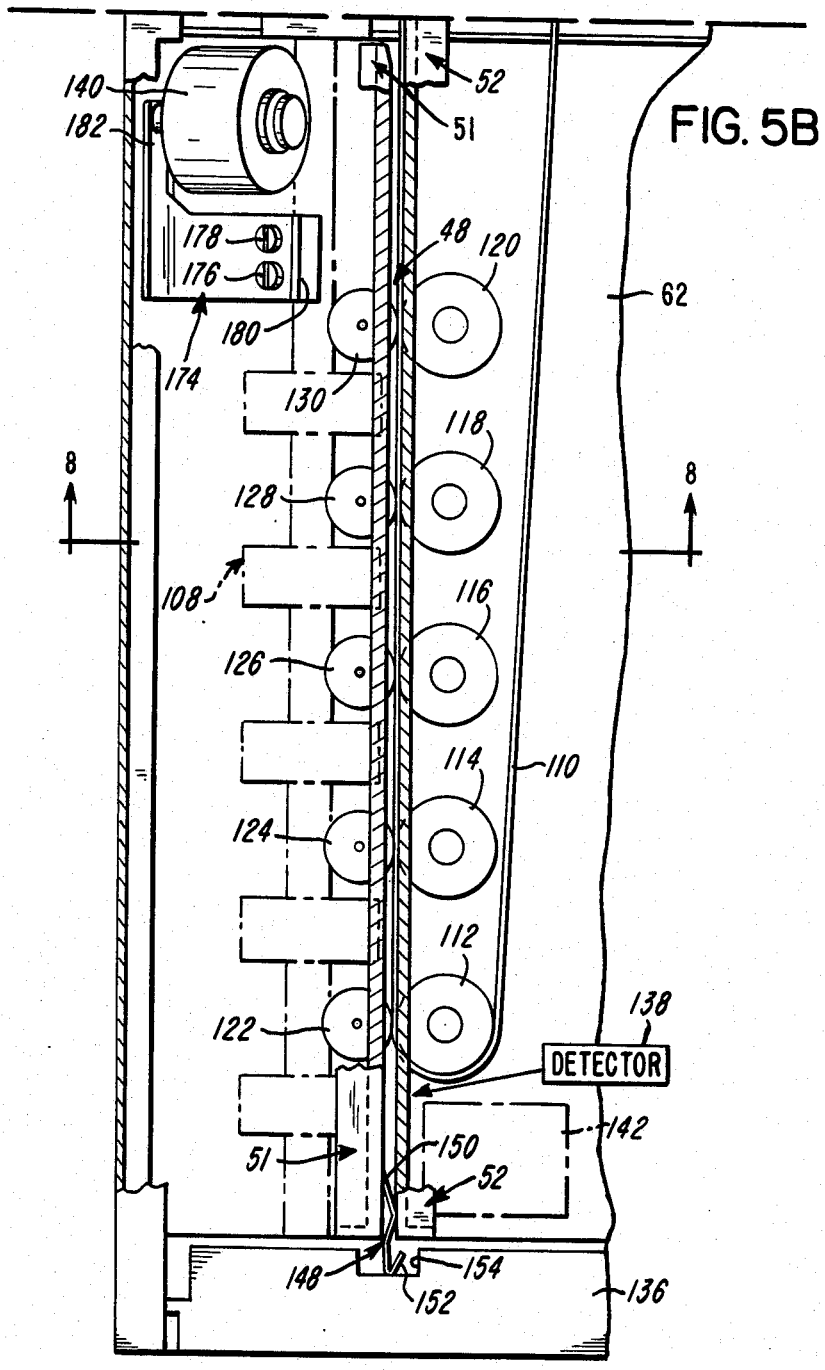

In FIG. 5A, a document 30 is shown entering (on its long, lower edge) the entry port 38 of the apparatus 12. Only a portion of the document 30 is shown; however, the document is being transferred from the encoder components 18 (FIG. 1) of the system 10. The apparatus 12 is detachably secured to the system 10 by suitable interlocking members shown only schematically as pins 54 and 56. The apparatus 12 also includes leveling screws 55 and 57 (FIG. 4) to enable it to be adjustably positioned relative to the system 10 to align the entry port 38 of the apparatus 12 with the exit port 40 of the system 10 to provide for a smooth transfer of documents therebetween.

The document track 44 (FIG. 5A) connects the input port 38 and the exit port 42 (FIG. 3) as previously explained. The track 44 is comprised of a first wall section 44-2 (upstanding from a base 58) and a second wall section 44-3 upstanding from its base 60. The sections 44-2 and 44-3 are spaced apart to receive the document 30 therebetween. The bases 58 and 60 are secured to a planar support 62 of the apparatus 12 by fasteners 64 and 66, respectively. The selector 46, alluded to earlier herein, is shown in the diverting position in FIG. 5A. The selector 46 is comprised of a curved wall 68 which is approximately a quarter of a circle and which is upstanding from and secured to the plate 70. The plate 70 is fixed to rotate with the driving shaft 72 which is rotatably supported in the planar support 62. An actuator, such as a rotary solenoid 74, is operatively coupled to the shaft 72 by linkage shown as dashed line 75, to rotate the shaft 72 in a clockwise direction (as viewed in FIG. 5A) to the position shown whenever the solenoid 74 is energized in the embodiment described. When the solenoid 74 is de-energized, a separate spring or a solenoid-contained spring (neither spring is shown) associated with the solenoid 74 rotates the shaft 72 and the selector 46 in a counter-clockwise direction to the second position mentioned. In the second position, the upstream edge 76 of the curved wall 68 is positioned behind the trailing edge 78 of the inlet port 38 to provide an obstruction-free path for documents to be transferred from the inlet port 38 to the exit port 42. Correspondingly, when the selector 46 is in the first position shown in FIG. 5A, the upstream edge 76 of the curved wall 68 is positioned behind the trailing edge 80 of the inlet port 38 to facilitate the smooth transporting of documents to the transfer station 48.

The means for moving the documents from the inlet port 38 to the exit port 42 of the apparatus 12 are conventional and include the driven roller 82 (FIG. 5A), the idler rollers 84 and 86, and the associated back-up or pinch rollers 92, 88, and 90. An endless flat belt 94 partially encircles the driven roller 82 and the idler roller 84, and it passes in front of the idler roller 86. These rollers and the belt 94 are positioned relative to the track 44 so that the belt extends slightly into the space between the track walls 44-2 and 44-3. The associated pinch rollers 88, 90 and 92 are resiliently biased towards the center of the track 44 and are substantially aligned with rollers 84, 86 and 82, respectively, to cooperate with the moving belt 94 to move the documents 30 towards the exit port 42. The belt 94 is located horizontally in the track 44 at a height (above the track floor) equal to about half the height of the documents 30 being transported thereby.

The means for moving the documents 30 in the track 44 also include the motor 96 whose output pulley 98 (FIG. 5A) is connected to a tandem drive pulley 100 by a belt 102 shown as a dashed line. The tandem drive pulley 100 is also coupled to driven pulley 82 by a driving belt 104 which is shown as a dashed line.

When a document 30 is selected or deflected towards the transfer station 48 (FIGS. 5A and 5B), as previously described, there is provided a first means designated generally as 106 for moving the selected document 30 in a first direction to the transfer station 48. Thereafter, a second means designated generally as 108 for moving the document 30 is used to move the document 30 in a second direction (downwardly, as viewed in FIG. 4) to the group of pockets 36.

Figure 8:
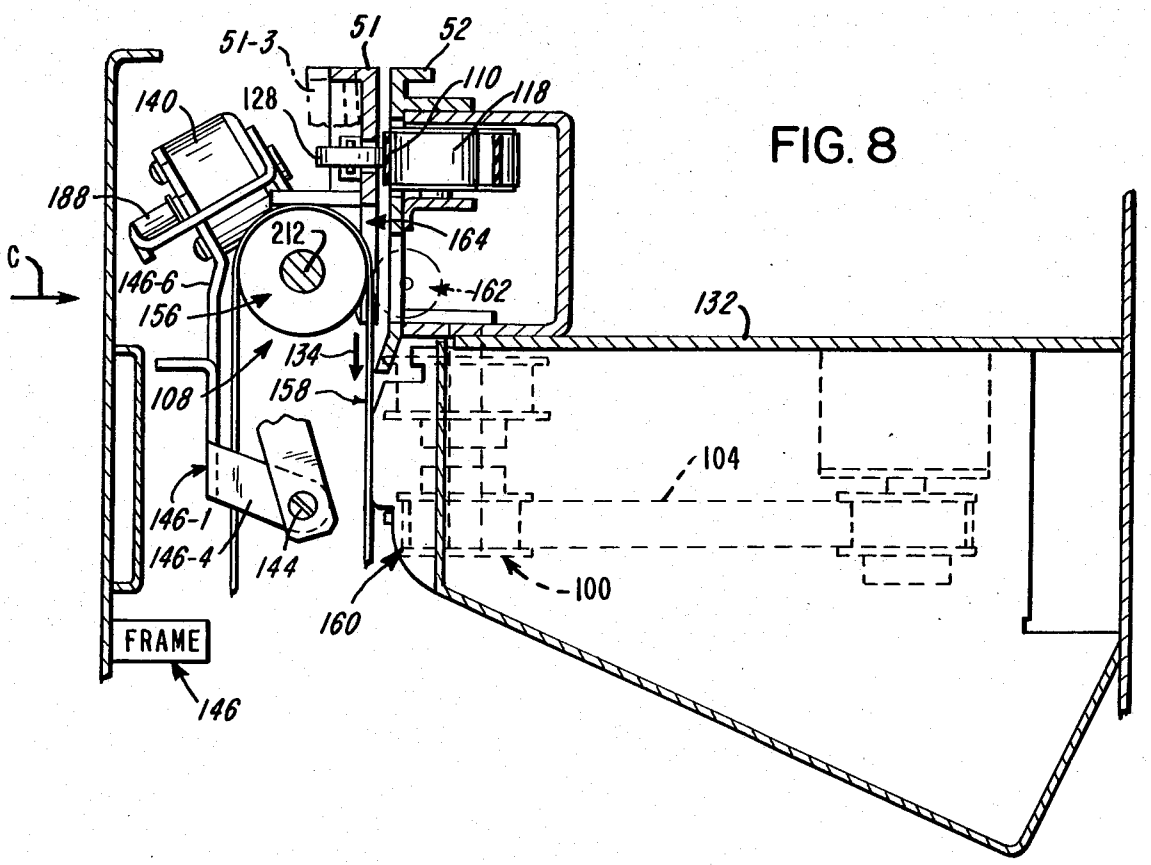
FIG. 8 is a cross-sectional view, in elevation, and is taken along the line 8—8 of FIG. 5B to show additional details of the first and second track members.

The first moving means 106 (FIGS. 5A and 5B) includes a roller 109 which is operatively driven in a counter-clockwise direction (as viewed in FIG. 5A) by the tandem pulley 100 previously mentioned. The first moving means 106 also includes a flat belt 110 which is mounted on the rollers 109 and 112, and which belt passes in front of rollers 114, 116, 118 and 120, as shown in FIG. 5B. The spaced, pinch rollers 122, 124, 126, 128 and 130 are aligned with the rollers 112, 114, 116, 118 and 120, respectively, to resiliently bias the document 30 into engagement with the flat belt 110 to enable the document to be moved in the first direction mentioned. The first direction with reference to the transfer station 48 means that the document 30 moves between the first and second track members 51 and 52 towards the reader when looking at. FIG. 8. Plate 132, which is oriented in a horizontal direction in FIG. 8 in the embodiment described, should help to orient the reader. The document 30 has to be supported between the rollers, like 128 and 118 and the belt 110, along the length of the transfer station 48 because there is no "bottom" (in the normal sense) to the transfer station. There is no "bottom" in order to facilitate the transfer of documents from the first direction to the second direction which, in FIG. 8, is downwardly along the direction of arrow 134.

Before a document 30 is moved in the second direction mentioned, the document is moved at a constant velocity by the first drive means 106 in the first direction towards the front drawer panel 136, shown in FIG. 5B. As the leading edge of the document 30 approaches the drawer panel 136, it encounters a conventional, light-and-sensor detector 138 which produces a stop signal which is forwarded to the control unit 20 (FIG. 2).

In response to the stop signal, the control unit 20 energizes solenoid 140 (FIG. 8) and simultaneously energizes solenoid 142 (FIG. 5B) to produce two separate activities to be described hereinafter.

When solenoid 140 is energized, it pivots the first track member 51 in a counter-clockwise direction (as viewed in FIG. 8) about pivot point 144 (shown as a screw) to the position shown in dashed outline as 51-3. The point 144 is fixed relative to a frame 146 which is shown only schematically in FIG. 8; this aspect will be discussed hereinafter. When the first track member 51 is moved to the position shown by dashed outline 51-3, the pinch rollers 122, 124, 126, 128 and 130, which are supported on the first track member 51, are moved away from and out of operative engagement with the moving belt 110 which is mounted on the second track member 52, thereby ceasing to positively drive the document 30 in the first direction towards the front drawer panel 136. Even though the positive driving of the document 30 is stopped, it has momentum which carries it towards a spring 148 (FIG. 5B) which decelerates and stops the document. The spring 148 is at least an inch wide, is made of thin, sheet steel, and has the general shape shown in FIG. 5B in which top edge of the spring is seen. The spring 148 has a first portion 150 which projects into the space between the first and second track members 51 and 52 (to decelerate a document 30 without damaging the leading edge thereof), and it also has a hook portion 152 on the end thereof. A light document 30 is decelerated and stopped generally by the first portion 150, and a heavier, card-like document 30 is decelerated by the first portion 150 of the spring 148 and stopped by the hook portion 152 thereof. The hook portion 152 of the spring 148 is located in a vertically-aligned recess 154 which provides clearance for the leading edge of a document as it is moved in the second direction or downwardly as viewed by arrow 134 in FIG. 8.

As alluded to earlier herein, the second moving means 108 is used to move a document 30 in the second direction or downwardly as shown by arrow 134 in FIG. 8 as just stated. The second moving means 108 includes a plurality of rollers shown as roller group 156, a plurality of spaced, longitudinally-aligned belts shown as belt group 158, a plurality of gliding blocks shown as block group 160, and a plurality of pinch rollers shown as pinch roller group 162. Before describing all the details of the second moving means 108, it appears appropriate to discuss, first, its general operation.

The activity which ensued when solenoid 140 was energized was described earlier herein, and when solenoid 142 is energized therewith, the following activities occur. When the solenoid 142 is energized, it moves the pinch rollers of the roller group 162 (FIG. 8) towards the belts of belt group 158 to resiliently bias a document 30, towards and into engagement with the belts of the belt group 158. The first track 51 has a plurality of spaced, parallel fingers shown as finger group 164 which are positioned to be located close to the second track 52 when the first track member 51 is in the solid position shown in FIG. 8; however, when the solenoid 140 is energized to move the first track member 51 to the position shown in dashed outline 51-3, the finger group 164 recedes away from the second track member 52 to expose the belts of the belt group 158. The pinch rollers of the roller group 162 then move the document 30 into engagement with the belts of the belt group 158, which belts then move the document downwardly in the second direction as shown by arrow 134. As the document 30 is moved downwardly by the belt group 158, the bottom, long edge of the document 30 engages the blocks of the block group 160, which cooperate with the belts of the belt group 158 to further drive the document downwardly to be directed to one of the pocket members of the group of pocket members 36 by the control unit 20. Thereafter, the solenoids 140 and 142 are de-energized by the control unit 20, permitting resilient means (to be later described) to return the first track member 51 to the home position shown in solid outline in FIG. 8 and to return the pinch rollers of the pinch roller group 162 from the active position shown in FIG. 8 to a home position which is located to the right of the position shown. This movement clears the rollers of group 162 from the space between the first and second track members 51 and 52 and permits the next succeeding document 30 to be moved freely in the first direction before being moved downwardly in the second direction as just described.

Having described the general operation of the apparatus, it appears appropriate to discuss additional details about the first track member 51. As previously alluded to, the first track member 51 is pivotally supported on point 144. Actually, there is an additional point 144-1 (FIG. 9) which is aligned with pivot point 144. The frame 146 shown only schematically in FIG. 8 includes the frame member 146-1 having an offset flange 146-2 (FIG. 10) which is secured to frame portion 146-3 by fasteners like 166. The frame member 146-1 also has the offset portions 146-4 and 146-5 which provide the support for the pivot points 144 and 144-1, respectively. The frame member 146-1 also includes an offset portion 146-6 (FIG. 9) to which the solenoid 140 is secured.

Figure 9:
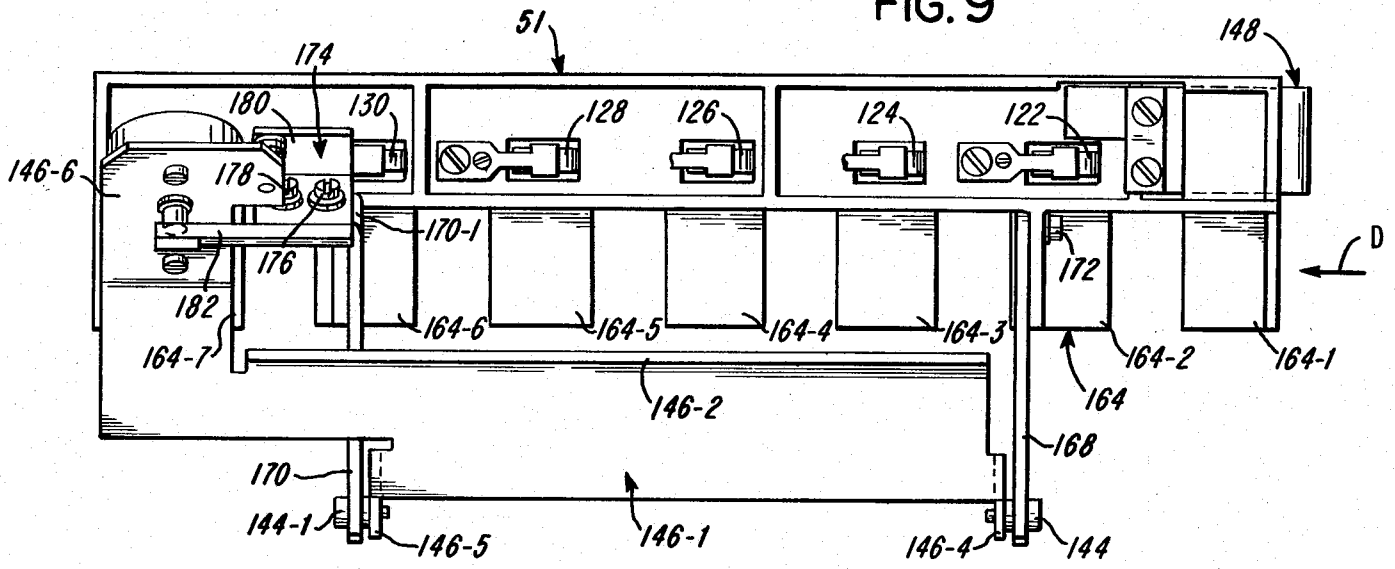
FIG. 9 is a side view, in elevation, and is taken from the direction C of FIG. 8 to show additional details of the first track member and the means for mounting it.
Figure 10:
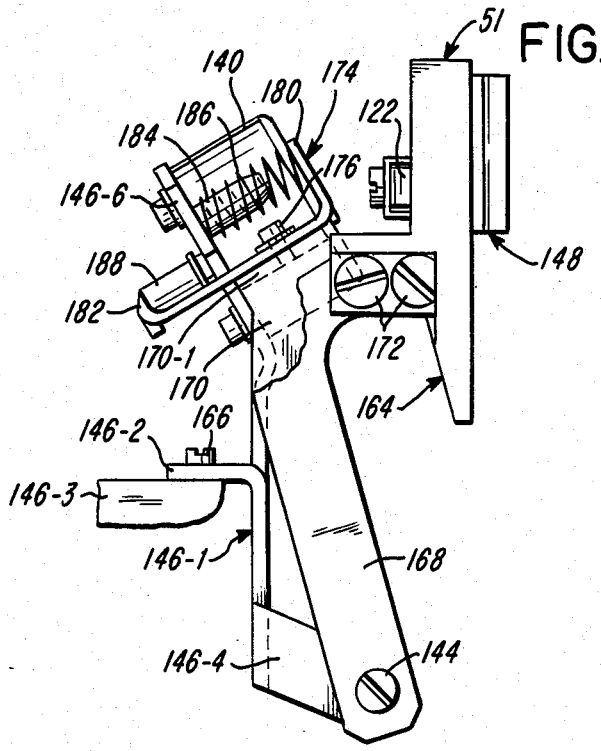
FIG. 10 is an end view, in elevation, and is taken from thee direction D of FIG. 9 to show additional details of the means for mounting the first track member.

The first track member 51 is pivotally supported on the frame member 146-1 (FIG. 10) by the levers 168 and 170. One end of lever 168 is pivotally mounted on the offset portion 146-4 by a fastener whose longitudinal axis represents the pivot point 144. The remaining end of lever 168 is fastened to the first track member 51, by the fasteners 172. Similarly, one end of lever 170 is pivotally mounted on the offset portion 146-5 (FIG. 9) by a fastener whose longitudinal axis represents the pivot point 144-1 which is aligned with pivot point 144. The upper end of lever 170 has a first offset portion (not shown) which enables the lever 170 to be secured to the first track member 51 by fasteners similar to fasteners 172 already discussed in relation to lever 168, and the lever 170 also has a second offset portion 170-1 (FIG. 9). A "U-shaped" channel member 174 is secured to the offset portion 170-1 by fasteners 176 and 178. The channel member 174 has a short, high wall section 180 and a narrower, longer, wall section 182 as seen best in FIG. 9; the member 174 is not shown in FIG. 8 to simplify that figure. A limiting pin 184 (FIG. 10) is mounted on the offset portion 146-6 of the stationary frame member 146-1 so as to abut against the wall section 180 as will be described hereinafter, and a compression-type spring 186 is mounted on the pin 184 between the offset portion 146-6 and the wall section 180. The pin 184 limits the pivoting movement of the first track member 51 in the counter-clockwise direction (as viewed in FIG. 10) to the position shown as 51-3 in FIG. 8. The compression-type spring 186 biases the first track member 51 to the home position or the position shown in solid outline in FIG. 8. When the solenoid 140 is energized as previously described, the operating plunger 188 of the solenoid engages the wall section 182 of the channel member 174 to pivot the first track member 51 in the counter-clockwise direction (as viewed in FIGS. 8 and 10) against the bias of spring 186 to the position shown in dashed outline 51-3 shown in FIG. 8. When the solenoid is de-energized, the spring 186 (FIG. 10) returns the first track member 51 to the home position.

Figure 6:
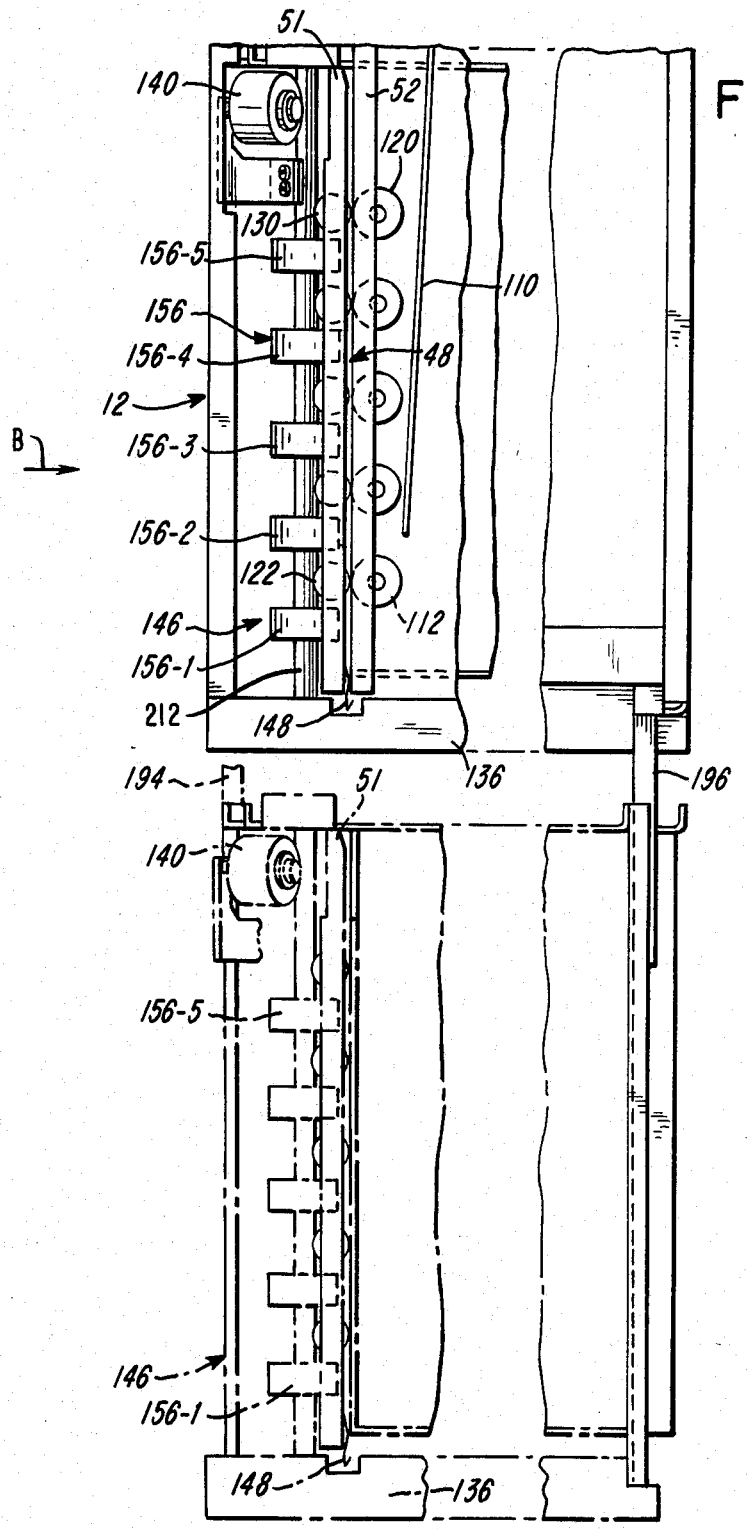
FIG. 6 is a plan view which is similar to that shown in FIG. 3, and this view is used to show the frame means for moving the left or first track member and the pocket members from a home position shown in solid outline to the extended position shown in dashed outline.
Figure 7:
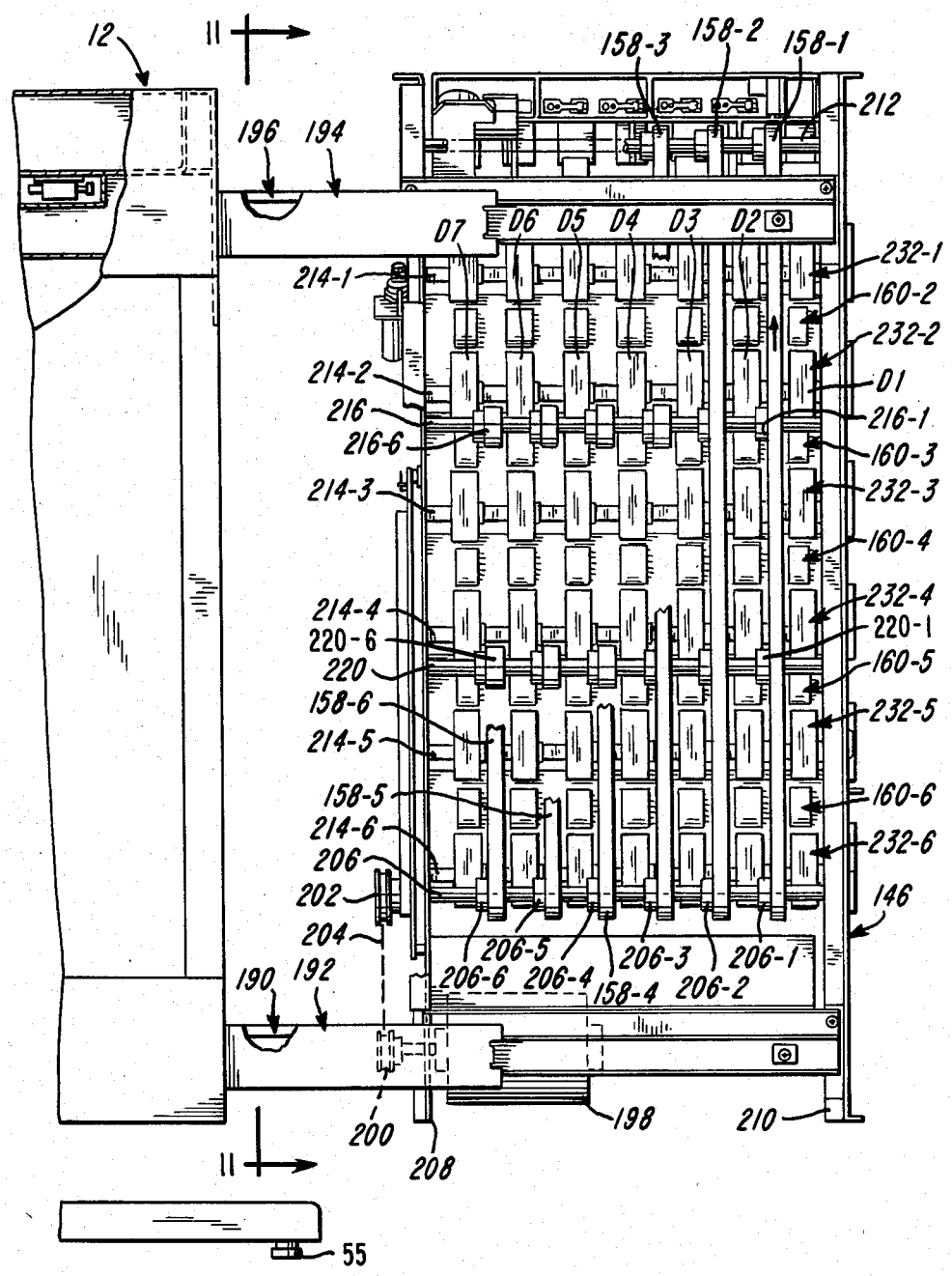
FIG. 7 is a side view, in elevation, and is taken from the direction of arrow B in FIG. 6 to show additional features of the means for moving the documents to the pocket members.

Having described how the first track member 51 (FIGS. 8, 9, 10) is mounted for pivotal movement on the frame 146, it appears appropriate to discuss how the frame 146 is mounted within the apparatus 12. It should be recalled from the earlier discussions herein that the first track member 51 is moveable in the first direction to an extended position shown in FIGS. 6 and 7 to facilitate the removal of a jammed document 30 or documents from the transfer station 48 (FIG. 5B). In this regard, the frame 146 is conventionally mounted on four, ball bearing slides 190, 192, 194 and 196, which are coupled to the apparatus 12 and the frame 146 to enable the frame 146, with the first track member 51 thereon, to be moved (in drawer-like fashion) out of the apparatus 12 as shown in FIGS. 6 and 7 and to be returned to the operative position shown in FIGS. 5A and 5B, for example. A suitable latch (not shown) keeps the frame 146 in the operative position shown in FIGS. 5A and 5B. Notice that when the frame 146 is pulled out to the pulled-out position shown in dashed outline in FIG. 6, any document 30 which was jammed at the transfer station 48 can be reached readily to unjam or dislodge it. Also, when the frame 146 is pulled out of the apparatus 12, any document 30 which might jam in any one of the selectors associated with the pockets of the pocket members 36 is readily accessible for removal.

Figure 11:
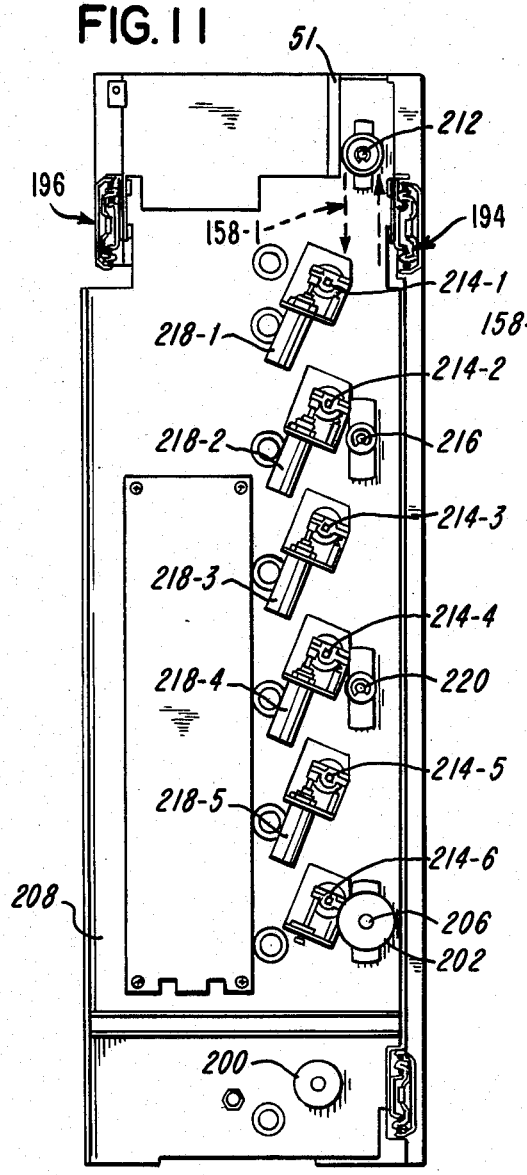
FIG. 11 is a cross-sectional view, in elevation, and is taken along the line 11—11 of FIG. 7 to show additional details of the frame which is pulled out in drawer fashion.

Continuing with a discussion of the first track member 51, the fingers associated with the finger group 164, which were alluded to with regard to the discussion of FIG. 8, are shown in more detail in FIG. 9. The fingers 164-1, 164-2, 164-3, 164-4, 164-5, 164-6 and 164-7 of the finger group 164 are spaced apart as shown so as to receive therebetween the rollers 156-1 (FIG. 6), 156-2, 156-3, 156-4, 156-5 and 156-6 (not shown) of the roller group 156, alluded to with regard to the discussion of FIG. 8. As previously stated, when the first track member 51 is in the home position shown in FIG. 8, the fingers 164-1 through 164-7 extend into the space between the track members 51 and 52 to keep the belts of the belt group 158 from interfering with the advancement of a document 30 in the first direction as previously described. The belts of the belt group 158 are driven by a motor 198 (FIG. 7) which is mounted on the frame 146 to move therewith. The output pulley 200 of the motor 198 is drivingly coupled to a driven pulley 202 by a belt shown only as dashed line 204. The pulley 202 rotates the shaft 206 which is rotatably mounted between the side frames 208 and 210 of the frame 146. There are six spaced, drive rollers 206-1, 206-2, 206-3, 206-4, 206-5 and 206-6 which are secured to the shaft 206 to rotate therewith, and the individual endless belts 158-1, 158-2, 158-3, 158-4, 158-5 and 158-6 of the belt group 158 are mounted, respectively on these drive rollers. At the upper end of the belt group 158, the endless belts 158-1, 158-2, 158-3, 158-4, 158-5 and 158-6 are mounted on the rollers 156-1 (FIG. 6), 156-2, 156-3, 156-4, 156-5 and 156-6 (not shown to simplify the drawing), respectively, and these named rollers are rotatably mounted on a shaft 212 which is rotatably mounted in the side frames 208 and 210. As an alternative, the rollers 156-1 through 156-6 may be fixed to shaft 212 to rotate therewith, and the shaft 212 may be positively driven by a drive pulley and timing belt (not shown) which are conventionally and operatively coupled to the output pulley 200 of motor 198 (FIG. 6). The belts of the belt group 158 are driven downwardly at the transfer station 48 as shown by arrow 134 in FIG. 8. There are rods 216 and 220 positioned between the driving shaft 206 and the shaft 212 as shown in FIG. 7. Rod 216 has rollers 216-1 through 216-6 rotatably mounted thereon with only rollers 216-1 and 216-6 being marked thereon to simplify the drawing. Similarly, rod 220 has rollers 220-1 through 220-6 rotatably mounted thereon, with only rollers 220-1 and 220-6 being marked thereon to simplify the drawing. These rods 216 and 220 with the corresponding rollers (as just identified) thereon, are used to force the document into sliding engagement with the blocks of block group 160 to thereby move the document 30 towards the pockets of the group 36 of pockets as previously described. While looking at FIG. 7, it should also be noted that there are six selector shafts 214-1, 214-2, 214-3, 214-4, 214-5, and 214-6 which are pivotally mounted between the side frames 208 and 210; these shafts are pivoted slightly when the associated solenoids 218-1, 218-2, 218-3, 218-4, and 218-5 (FIG. 11) are energized. The solenoids 218-1 through 218-5 are energized by the control unit 20 to divert a document into the associated pocket #1 through #5 (FIG. 4) of the group 36 of pockets. The bottom most shaft 214-6 does not need a solenoid to actuate it because any document 30 which is not selected by the actuation of solenoids 218-1 through 218-5 will go into the last pocket #6. This aspect will be discussed later herein.

Figure 12:
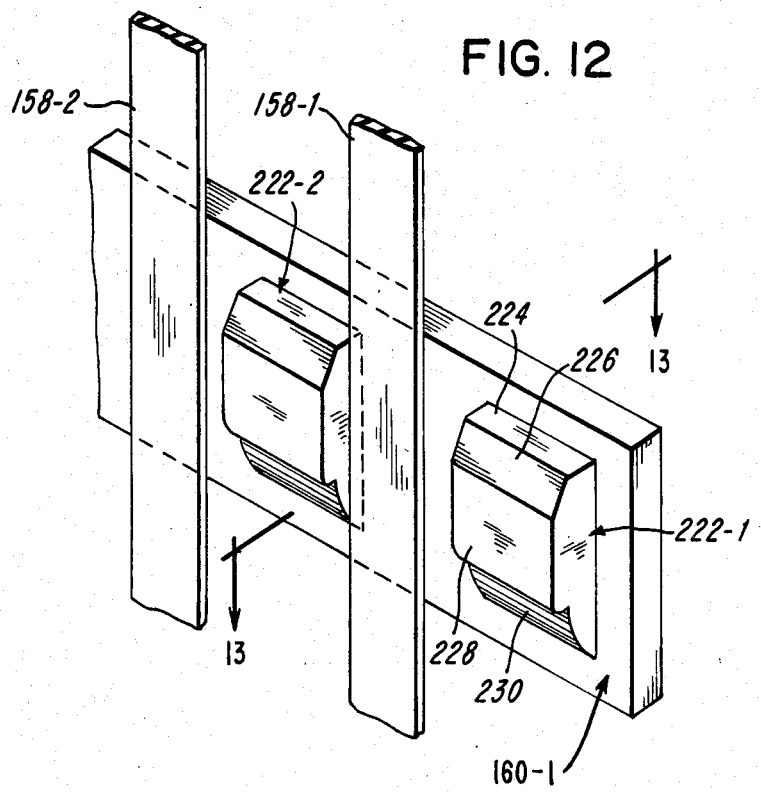
FIG. 12 is a general perspective view of certain elements included in the means for moving a document in the second direction towards the pocket members of the pocketing apparatus.

Part of the second means 108 for moving a document 30 in the second direction (according to arrow 134 in FIG. 8) includes the blocks of the block group 160. In this regard, FIG. 12 shows a line 160-1 of blocks included in the block group 160, and the remaining lines 160-2, 160-3, 160-4, 160-5, and 160-6 of blocks included in group 160 are shown in FIG. 7. The lines 160-1 through 160-6 are all identical; therefore, a discussion of the line 160-1 of blocks shown in FIG. 12 will suffice.

The line 160-1 of blocks (FIG. 12) includes a plurality of identical blocks 222-1, 222-2, 222-3, 222-4, 222-5, 222-6, and 222-7 in spaced, aligned relationship, with only blocks 222-1 and 222-2 being shown in FIG. 12. The blocks, like 222-1 and 222-2, are spaced apart to receive therebetween a belt, like 158-1, of the belt group 158. In the embodiment described, the line of blocks 160-1 is formed of plastic material of about three millimeters thick, with the blocks being formed thereon generally like the "blisters" on "blister packages". The block 222-1 has a top side 224, a sloping side 226, a front side 228, and a lower side 230 as shown in FIG. 12.

Figure 13:
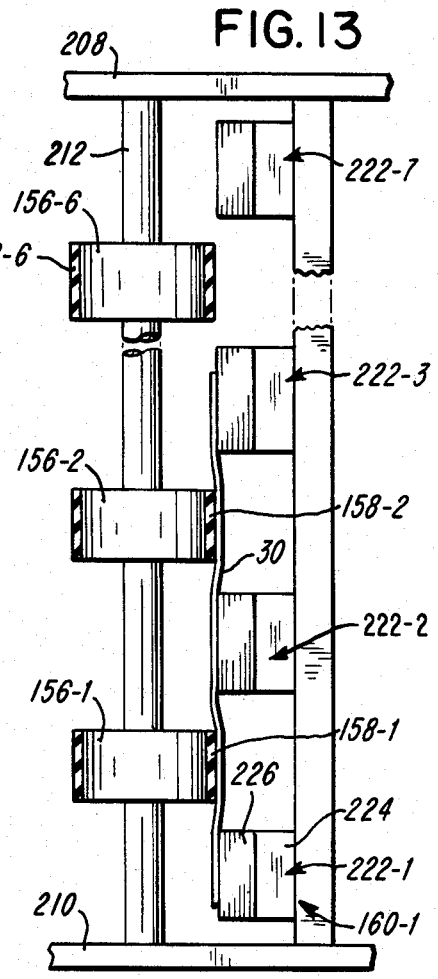
FIG. 13 is a cross-sectional view, taken along the line 13—13 of FIG. 12 to show how a document is forced into a general corrugated shape when being moved in the second direction towards the pocket members.

FIG. 13 is a schematic diagram which is taken along the general line 13—13 of FIG. 12 to show how a document 30 assumes a general, corrugated shape as it is moved downwardly along arrow 134 (FIG. 8) as previously alluded to. FIG. 13 is not drawn to scale, and it is exaggerated to show how the rollers 156-1 through 156-6 of the roller group 156 are positioned relative to the line of blocks 160-1, for example, to cause the document 30 to assume the corrugated shape mentioned. The sloping side 226 of the blocks, like 222-1, is used to direct the document 30 towards the belts of the belt group 158, and the document is supported between the front side 228 and the belts, like 158-1 and 158-2, of the belt group 158 in the example described, as the document is moved downwardly.

Figure 14:
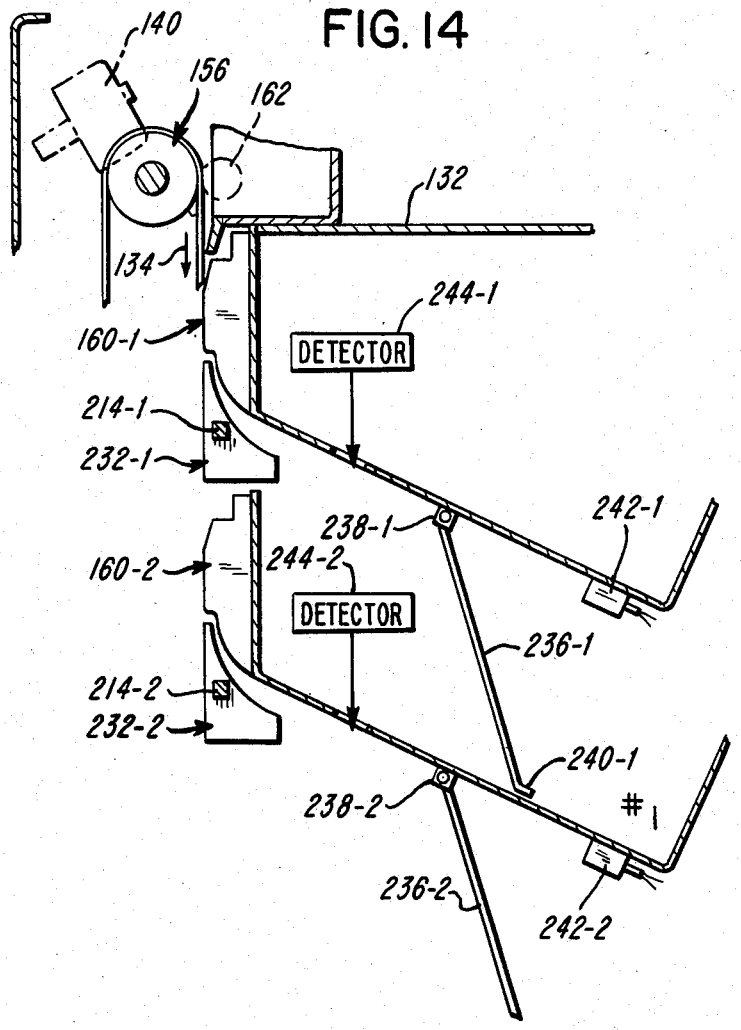
FIG. 14 is a view which is similar to FIG. 8, and it shows the selectors which are used to divert documents into the various pocket members.

As a document 30 is moved downwardly, as shown by arrow 134 in FIG. 14, it approaches a plurality of lines of vertically-aligned selectors or diverter lines like lines 232-1 and 232-2 which have the general outline shown. The diverter line 232-1 is associated with pocket #1, and similarly, diverter lines 232-2, 232-3, 232-4, 232-5, and 232-6 (FIG. 7) are associated, respectively, with pockets #2 through #6. As seen in FIG. 7, each line of diverters, like 232-2, includes the diverters D1, D2, D3, D4, D5, D6, and D7 which are aligned with the blocks of the line of blocks like 160-2, for example. This construction enables the long, lower edge of a document 30 to be selected or diverted into the appropriate pocket #1 through #6. The diverters D1 through D7 are fixed to a square shaft like 214-2 (FIG. 14) to rotate therewith. The shaft 214-2 is coupled to the solenoid 218-2 (FIG. 11), and when a document 30 is to be routed to pocket #2, for example, the line 232-2 of diverters (FIG. 14) is rotated in a counterclockwise direction (as viewed in FIG. 14) by energizing solenoid 218-2 to cause the document to be diverted towards pocket #2 to fall therein. Energization of the appropriate solenoids 218-1 through 218-5 is effected by the control unit 20 to divert the documents as previously described. A separate spring (not shown) associated with each of the solenoids 218-1 through 218-5 is used to return the line of diverters, like 232-2, to the home position shown in FIG. 14. The line 232-6 of diverters (FIG. 7) may be permanently positioned in the diverting position to divert the documents into pocket #6 because it is the last pocket in the line of pockets, and consequently, an operating solenoid, like 218-5, is not needed for the line 232-6 of diverters. The belts of the belt group 158 have a high coefficient of friction when compared to the low coefficient of friction of the blocks of the block group 160; this enables the documents 30 to be positively driven downwardly by the belts.

As the documents 30 accumulate in the pockets #1 through #6 (FIG. 14) in a typical pocketing operation, the levers 236-1 through 236-6 (only levers 236-1 and 236-2 are shown) associated with pockets #1 through #6 begin to rotate in a counter-clockwise direction (as viewed in FIG. 14) about their associated pivot blocks, like 238-1 and 238-2. When a pocket, like #1, approaches the full level, a magnet 240-1 on the end of lever 236-1 coacts with a detector, like 242-1, to produce a "full" signal which indicates to the control unit 20 that the pocket #1 is full. In the embodiment described, the detector 242-1 is a Hall-effect detector. Each of the remaining levers 236-2 through 236-6 has a magnet (not shown), like 240-1, on the end thereof, to cooperate with the associated detectors 242-2 through 242-6 of the pockets #2–#6. The detectors 242-1 through 242-6 are shown collectively as 242 in FIG. 2.

Each pocket #1 through #6 (FIG. 14) has a document present detector 244-1 through 244-6 (shown collectively as 244 in FIG. 2) associated respectively therewith, to give a "present" signal to the control unit 20 whenever a document 30 enters the associated pocket. The control unit 20 has conventional routines stored in its ROM 22 or RAM 24 to monitor the elapsed time between detecting the leading edge of a document 30 at detector 138 (FIG. 5B) located at the transfer station 48 and detecting the presence of the document 30 at one of the document present detectors 244-1 through 244-6. If a document 30 does not arrive at its intended selected pocket within a predetermined elapsed time, the control unit 20 indicates to the operator that a possible document jam has occurred by giving an indication on the display 16, for example. The movement of documents 30 between the apparatus 12 and apparatus 12-1, for example, can be similarly monitored.

Figure 15:
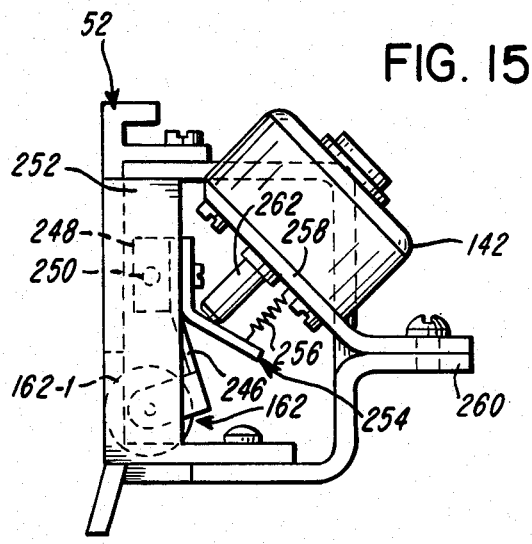
FIG. 15 is an end view of the second track member and is taken from the same direction as FIG. 8; it shows how a solenoid moves certain rollers into operative engagement with the vertically-aligned belts of the belt group located and the moveable frame means on which the left track is located.

FIG. 15 is an end view of the second track member 52, and it is used to show how the pinch rollers of the pinch roller group 162 (FIG. 8) are moved into operative engagement with the longitudinally-aligned belts of the belt group 158. One pinch roller 162-1 through 162-5 is provided for aligned, opposed relationship with one of the rollers 156-1 through 156-5 (FIG. 6) as previously discussed, although only roller 162-1 is shown in FIG. 15. Roller 162-1 is mounted on one end of a cantilever-type, flat spring 246 whose remaining end is secured to a mounting bar 248 which extends along the length of the second track member 52. The bar 248 is pivotally mounted on frame ends 252 by the mounting rods 250 which extend from the bar 248. A camming lever 254 has one end thereof secured to the bar 248, and the remaining end thereof has one end of a tension spring 256 secured thereto. The remaining end of the spring 256 is secured to a stationary support 258 which is secured to a flange 260 of the second track member 52. When the solenoid 142 is energized, its plunger 262 pivots the camming lever 254 (and the bar 248) in a clockwise direction (as viewed in FIG. 15) about the rods 250 (as a pivoting axis) to thereby move the pinch rollers of roller group 162 from the inoperative position shown in FIG. 15 to the operative position shown in FIG. 8. When the solenoid 142 is de-energized, the spring 256 returns the roller group 162 to the home or inoperative position shown in FIG. 15.

Some miscellaneous points need to be mentioned. A brush 264 (FIG. 5A) which is located at the entrance to the transfer station 48 is used to minimize static electricity associated with moving the documents 30. The rollers, like 88 (FIG. 5A) pass through aligned slats in the curved wall 226 which functions as a guide to direct documents 30 toward the transfer station 48 as previously described. A conventional test circuit 268 (FIG. 2) which is part of the apparatus 12 may be used to test certain functions of the apparatus as is done, conventionally.

What is claimed is:

1. A pocketing apparatus comprising:

a plurality of pocket members for selectively receiving documents to be pocketed;

a transfer station to receive said documents to be pocketed;

a first means and a second means positioned at said transfer station to receive said documents therebetween;

first moving means for moving a said document to be pocketed in a first direction in a plane to said transfer station;

second moving means for moving said document in a second direction in said plane from said transfer station to said plurality of pocket members; and means for mounting one of said first and second means for reciprocal movement parallel to said plane and along said first direction to facilitate removing a said document which may become jammed at said transfer station;

said first and second directions being substantially perpendicular to each other.

2. The pocketing apparatus as claimed in claim 1 in which said first moving means comprises:

an entry port to said apparatus and an exit port from said apparatus;

third moving means for moving a said document from said entry port to said exit port; and a selector located between said entry and exit ports for selectively diverting a document from said third moving means to said transfer station.

3. The pocketing apparatus as claimed in claim 2 in which said entry and exit ports are located within a said pocketing apparatus to enable at least two said pocketing apparatuses to be operatively connected together to thereby enable a document passing from a said exit port of an upstream one of said pocketing apparatuses to enter said entry port of the adjacent downstream one of said pocketing apparatuses.

4. The pocketing apparatus as claimed in claim 3 in which said plurality of pocket members is aligned vertically;

said second direction is aligned substantially vertically downwardly; and said plurality of pocket members is located substantially below said transfer station.

5. The pocketing apparatus as claimed in claim 4 in which said first moving means includes a first driving means on said second means and a cooperating member on said first means for moving a said document in said first direction.

6. A pocketing apparatus comprising:

a plurality of pocket members for selectively receiving documents to be pocketed;

a transfer station to receive said documents to be pocketed;

a first means and a second means positioned at said transfer station to receive said documents therebetween;

first moving means for moving a said document to be pocketed in a first direction to said transfer station;

second moving means for moving said document in a second direction from said transfer station to said plurality of pocket members; and means for mounting one of said first and second means for movement along said first direction to facilitate removing a said document which may become jammed at said transfer station;

said first and second directions being substantially perpendicular to each other;

said first moving means comprising:

an entry port to said apparatus and an exit port from said apparatus;

third moving means for moving a said document from said entry port to said exit port; and a selector located between said entry and exit ports for selectively diverting a document from said third moving means to said transfer station;

said entry and exit ports being located within a said pocketing apparatus to enable at least two said pocketing apparatuses to be operatively connected together to thereby enable a document passing from a said exit port of an upstream one of said pocketing apparatuses to enter said entry port of the adjacent downstream one of said pocketing apparatuses;

said first and second directions being substantially perpendicular to each other;

said plurality of pocket members being aligned vertically;

said second direction being aligned substantially vertically downwardly; and said plurality of pocket members being located substantially below said transfer station;

said first moving means including a first driving means on said second means and a cooperating member on said first means for moving a said document in said first direction;

said second moving means including a second driving means located on said first means for moving a said document from said transfer station to said plurality of pocket member; and said second moving means also including an actuator on said second means for moving a said document at said transfer station into engagement with said second driving means, and also including a second actuator to move said first means away from said second means to enable said second actuator to move said document into operative engagement with said second driving means.

7. The pocketing apparatus as claimed in claim 6 in which said second driving means includes a plurality of spaced parallel endless belts and a plurality of spaced projections which are interspersed among said parallel endless belts to force a said document to assume a generally-corrugated shape when said document is in operative engagement with said endless belts and said spaced projections.

8. An apparatus for pocketing documents, comprising:

a frame;

means for mounting said frame for reciprocal movement between a home position and an extended position relative to said apparatus;

a plurality of pocket members mounted on said frame for selectively receiving documents to be pocketed;

a transfer station having first and second track members td receive a said document therebetween; said first track member being mounted on said frame for movement therewith;

first means for moving a said document in a first direction in a plane to said transfer station;

second means for moving said document in a second direction in said plane from said transfer station to said plurality of pocket members; and transfer means for transferring a document at said transfer station from said first moving means to said second moving means;

said first track member being movable in said first direction and parallel to said plane when said frame is moved from said home position to said extended position to enable a said document which may jam at said transfer station to be removed therefrom;

said first and second directions being substantially perpendicular to each other and said plurality of pocket members being in vertical alignment with one another along said second direction.

9. An apparatus for pocketing documents comprising:

an entry port for receiving documents into said apparatus, an exit port for discharging documents therefrom, and means for moving a said document from said entry port to said exit port;

a transfer station to receive said documents to be pocketed;

a diverter located in said moving means to selectively divert a document moving in said moving means from said entry port to said transfer station;

a first track member and a second track member positioned at said transfer station to receive therebetween said document from said diverter;

said second track member having first driving means thereon for moving said document in a first direction at said transfer station; said first track member having first cooperating members thereon to cooperate with said first driving means to move said document in said first direction;

a frame and means for slidably supporting said frame in said apparatus for reciprocal movement along said first direction;

a plurality of pocket members for selectively receiving said documents to be pocketed; said plurality of pocket members being mounted on said frame for movement therewith;

means for mounting said first track member on said frame for reciprocal movement therewith and also for pivoting movement between first and second positions relative to said frame;

a detector for producing a stop signal when said document reaches a predetermined position in said transfer station;

an actuator for moving said first track member from said first position to said second position in response to said stop signal, in which said second position said cooperative members are out of engagement with said first driving means to thereby stop said document at said transfer station;

second driving means mounted on said frame for moving said documents in a second direction from said transfer station to said plurality of pocket members;

said second track member having an actuator thereon to move a said document into operative engagement with said second driving means in response to said stop signal to thereby enable said second driving means to move said documents to said plurality of pocket members.

10. The apparatus as claimed in claim 9 in which said first and second directions are substantially perpendicular to each other.

11. The apparatus as claimed in claim 10 in which said entry and exit ports are located within a said apparatus to enable at least a second apparatus which is identified to said apparatus to be operatively connected to said apparatus to enable a document passing from a said exit port of an upstream one of said apparatuses to enter said entry port of the adjacent downstream one of said apparatuses.

12. The apparatus as claimed in claim 11 in which said first driving means includes an endless belt and said cooperating members are pinch rollers.

13. The apparatus as claimed in claim 12 in which said second driving means includes a plurality of spaced parallel endless belts and a plurality of spaced projections which are interspersed among said parallel endless belts to force a said document to assume a generally-corrugated shape when it is in operative engagement with said endless belts and said spaced projections.

14. The apparatus as claimed in claim 13 in which said first track member has protective members which permit said endless belts of said second driving means to be exposed when said first track member is moved to said second position.

15. The apparatus as claimed in claim 14 in which said moving means includes a means for selectively controlling the movement of said documents from said entry port to said exit port and said plurality of pocket members.

16. An apparatus for pocketing documents comprising:

an entry port for receiving documents into said apparatus, and an exit port for discharging documents therefrom;

means for moving a said document from said entry port to said exit port;

a frame;

means for mounting said frame for reciprocal movement between a home position and an extended position relative to said apparatus;

a plurality of pocket members mounted on said frame for selectively receiving documents to be pocketed when said frame is in said home position;

a transfer station having first and second track members to receive a said document therebetween; said first track member being mounted on said frame for movement therewith;

a control unit;

a diverter located in said moving means for selectively diverting a document from said entry port to said transfer station in response to a first signal from said control unit;

first means for moving a said document to be pocketed in a first direction in a plane from said diverter to said transfer station;

second means for moving said document in a second direction in said plane from said transfer station to said plurality of pocket member; and transfer means for transferring a document at said transfer station from said first moving means to said second moving means in response to a second signal from said control unit;

each of said pocket members having a diverter associated therewith to enable a document being moved by said second moving means to be diverted into the associated said pocket member in response to a corresponding divert signal from said control unit;

said first track member being movable in said first direction when said frame is moved from said home position to said extended position to enable a said document which may jam at said transfer station to be removed therefrom; and said first and second directions being substantially perpendicular to each other.

17. The apparatus as claimed in claim 16 in which said entry and exit ports are located within said apparatus to enable at least a second apparatus which is identical to said apparatus to be operatively connected to said apparatus to enable a document passing from a said exit port of an upstream one of said apparatuses to enter said entry port of the adjacent downstream one of said pocketing apparatuses.

* * * * *